US008726945B2

(12) United States Patent
Sand et al.

(10) Patent No.: US 8,726,945 B2
(45) Date of Patent: May 20, 2014

(54) CHEMICAL DISPENSING RESERVOIR APPARATUS AND METHODS

(75) Inventors: William F. Sand, Cincinnati, OH (US); Matthew S. Hayas, Cincinnati, OH (US)

(73) Assignee: Cintas Corporation, Cincinnati, OH (US)

( * ) Notice: Subject to any disclaimer, the term of this patent is extended or adjusted under 35 U.S.C. 154(b) by 1081 days.

(21) Appl. No.: 12/605,673

(22) Filed: Oct. 26, 2009

(65) Prior Publication Data

US 2010/0078091 A1 Apr. 1, 2010

Related U.S. Application Data

(63) Continuation-in-part of application No. 29/284,374, filed on Sep. 6, 2007, now Pat. No. Des. 604,799.

(60) Provisional application No. 61/109,671, filed on Oct. 30, 2008.

(51) Int. Cl.
*B65B 1/48* (2006.01)
*B65B 3/30* (2006.01)

(52) U.S. Cl.
CPC .... *B65B 1/48* (2013.01); *B65B 3/30* (2013.01)
USPC ..... 141/2; 141/18; 141/83

(58) Field of Classification Search
CPC ..... B65B 1/48; B65B 3/30
USPC ..... 141/1, 2, 104, 83; 222/1
See application file for complete search history.

(56) References Cited

U.S. PATENT DOCUMENTS

| | | | | |
|---|---|---|---|---|
| D203,883 | S | 2/1966 | Wood | |
| D208,011 | S | 6/1967 | Swayze | |
| 3,976,227 | A * | 8/1976 | Ray | 222/136 |
| 4,079,629 | A * | 3/1978 | Hope | 73/427 |
| 4,079,859 | A * | 3/1978 | Jennings | 222/1 |
| D256,719 | S | 9/1980 | Rose | |
| D265,795 | S | 8/1982 | Keith et al. | |
| D282,244 | S | 1/1986 | Santoiemmo | |
| D310,782 | S | 9/1990 | Durand | |
| D313,935 | S | 1/1991 | Miller | |
| 5,154,314 | A * | 10/1992 | Van Wormer | 222/1 |
| D332,544 | S | 1/1993 | Steiner et al. | |
| D342,176 | S | 12/1993 | Steiner et al. | |
| D350,604 | S | 9/1994 | Weiss et al. | |
| D352,545 | S | 11/1994 | Raffo | |
| D356,542 | S | 3/1995 | Finkiewicz et al. | |
| D400,795 | S | 11/1998 | de Baschmakoff | |
| D407,826 | S | 4/1999 | Yamazaki et al. | |
| D431,472 | S | 10/2000 | Cain et al. | |
| D451,394 | S | 12/2001 | Studer | |
| 6,370,488 | B1 * | 4/2002 | Beaudoin et al. | 702/188 |
| D472,155 | S | 3/2003 | DeKoning et al. | |

(Continued)

*Primary Examiner* — Gregory Huson
*Assistant Examiner* — Nicolas A Arnett
(74) *Attorney, Agent, or Firm* — Wood, Herron & Evans, LLP

(57) ABSTRACT

Removable chemical reservoirs are translucent and have filling marks on a front, hollow handle where chemical concentrate fill levels are visible and measurable. The reservoirs are filled with new concentrate from a current fill level mark to a full level mark and the volume of concentrate filled between the marks is calculated for filling and inventory purposes. The front handle is narrower than the reservoir sides and flanges at the upper end of the reservoir to facilitate in and out sliding of the reservoir for billing and cleaning.

17 Claims, 8 Drawing Sheets

(56) References Cited

U.S. PATENT DOCUMENTS

| | | | | |
|---|---|---|---|---|
| 7,028,861 | B2 * | 4/2006 | Sayers et al. | 222/1 |
| 7,111,650 | B2 * | 9/2006 | Few | 141/98 |
| D539,653 | S | 4/2007 | James et al. | |
| D540,174 | S | 4/2007 | Lux | |
| D558,577 | S | 1/2008 | Pettigrew et al. | |
| D582,000 | S | 12/2008 | Campbell | |
| 2005/0258186 | A1 * | 11/2005 | Hart et al. | 222/1 |
| 2007/0012378 | A1 * | 1/2007 | Miller et al. | 141/104 |

* cited by examiner

CHEMICAL DISPENSING RESERVOIR APPARATUS AND METHODS

RELATED APPLICATION

This application is a continuation-in-part application of applicant's co-pending U.S. Design patent application Ser. No. 29/284,374, entitled "REFILLABLE CHEMICAL RESERVOIR" and filed Sep. 6, 2007, the disclosure of which is incorporated herein by reference in its entirety.

PRIORITY CLAIM

Applicant claims priority of the filing date of Oct. 30, 2008 of U.S. provisional patent application Ser. No. 61/109,671, entitled "CHEMICAL DISPENSING RESERVOIR APPARATUS AND METHODS", the disclosure of which is incorporated herein by reference in its entirety.

BACKGROUND OF THE INVENTION

This invention relates to chemical proportioning apparatus and methods and more particularly to the field of apparatus and methods for supplying chemicals in a dispensing system wherein chemicals are drawn into a diluent and dispensed as a desired chemical mixture.

It has been known to provide a chemical dispenser with a plurality of concentrated chemical reservoirs or containers. Eductors are used to draw selected concentrated chemicals from respective reservoirs into a diluent, such as a flowing water stream. The mixed diluent and chemical are then dispensed into a further receptacle for use. Particular applications are, for example only, in the cleaning or sanitizing field where diluted chemicals are dispensed into receptacles such as spray bottles or buckets from which the mix is used to clean or disinfect surfaces, or both.

Such systems require periodic replenishment of the concentrated chemicals. Typically, a supplier or vendor will make a periodic visit to a chemical customer using the chemicals and deliver to the customer's inventory a sufficient number of chemical concentrate containers to fulfill the customer's needs until the next vendor visit. The customer is billed for the volume of concentrate or the number of fresh containers delivered.

This process is burdened with the need for the customer to finance the cost of the concentrate it retains in its inventory. The inventory supply must be sufficient for use until the next vendor visit, the frequency of which is most likely driven by factors other than need for chemical concentrates. For example, the vendor is typically a supplier of other customer needs, services, or consumables. If the chemical concentrate must be replenished on a more frequent basis, it may not be efficient for the vendor to visit on such a more frequent basis. Thus, the need for a customer/end user to purchase and store an inventory of concentrates.

Moreover, when an end user replaces a chemical container in his dispenser, it is common that a small amount of residual chemical remains in the container. Over time, the cost of this wasted, paid for concentrate becomes a significant expense.

Current structures of concentrate reservoirs and the apparatus in which they are used contribute to this problem. It is easier to simply remove one partially depleted container and attach a new one without worry of dumping unused concentrate into a new container, even if there were appropriate openings or ports to do that. Spills could be dangerous or contaminate the dispenser or its immediate area or location.

Small volume reservoirs, coupled with frequent vendor visits increases the waste and expense.

Moreover, an added and wasteful expense in this prior system arises from the cost of discarded or replaced containers, or the time and expense of cleaning and recycling containers, even if that could be accomplished.

Accordingly, it is desired to eliminate concentrated chemical waste while, at the same time, accommodating concentrated chemical refills so a constant supply is available, all while reducing the cost and space required for inventory.

It is also desired to provide apparatus to facilitate provision of adequate concentrated chemical supply without waste of containers or other concentrated chemical packaging.

It is also desired to facilitate periodic chemical vendor servicing of chemical dispensing systems, while reducing waste and concentrated chemical handling by the customer.

To these ends, a preferred embodiment of the invention contemplates a removable but reusable, refillable reservoir adapted to a dispenser apparatus and provided with "fill lines" or marks and made of material at least translucent so the content level can be seen in relation to the fill lines or marks. When a vendor arrives at the end user's facility, he simply fills an appropriate volume of concentrated chemical into the appropriate reservoir in the dispenser, noting the starting "fill" line and the "full" line of the replenished chemical. A simple calculation represents the amount of concentrated chemical filled into the reservoir and a notation of that amount is recorded manually or electronically for end user billing, inventory or other control purposes. In this way, the customer is billed only for what he receives (and eventually uses) and does not waste any unused chemical otherwise discarded in the old system when the reservoir was replaced.

In addition, the invention contemplates the use of different size reservoirs as a function of the volume of chemical concentrate anticipated to be used between scheduled visits of the chemical vendor. Large volume reservoirs are used in the dispenser where larger volumes of concentrated chemicals will be used between visits. When smaller volume use is anticipated for a given duration between "refill" visits, smaller reservoirs can be used. Preferably, each reservoir has common upper structure so that both larger and smaller reservoirs can be operationally placed in any position in the dispenser apparatus. As a result, the need for financing and storing surplus chemical concentrate is eliminated.

In this regard, the reservoir is uniquely shaped to serve multiple functions. Two top openings are respectively used for filling (front opening) and chemical pickup for mixing (rear opening). The side flanges at the top support the reservoir in the dispenser enclosure and allow the reservoir to slide in and out during chemical refilling and/or container cleaning or replacement. The front integral handle shape of the reservoir with the side indentations allow the user to grab the bottle from the front for easier handling. This becomes more important as the size of the bottle increases. Graduation marks and the translucent nature of the reservoir wall allow the user to easily see how much chemical is in the bottle or is refilled. There is a large flat front surface on the handle of the reservoir for label placement. All of these features are unique to the operation of the improved reservoir system.

These objectives and advantages will be even more readily understood from the following written description and from the drawings in which:

BRIEF DESCRIPTION OF THE DRAWINGS

FIGS. 2-5 show the invention with broken lines to illustrate that the reservoirs of the invention may be of any length;

DETAILED DESCRIPTION OF THE INVENTION

Figure 6:
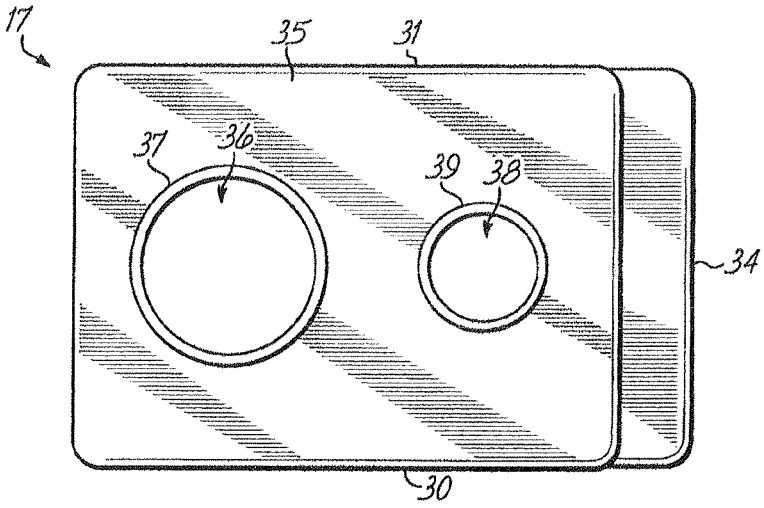
FIG. 6 is a top plan view of the invention of FIGS. 1 and 2.
Figure 7:
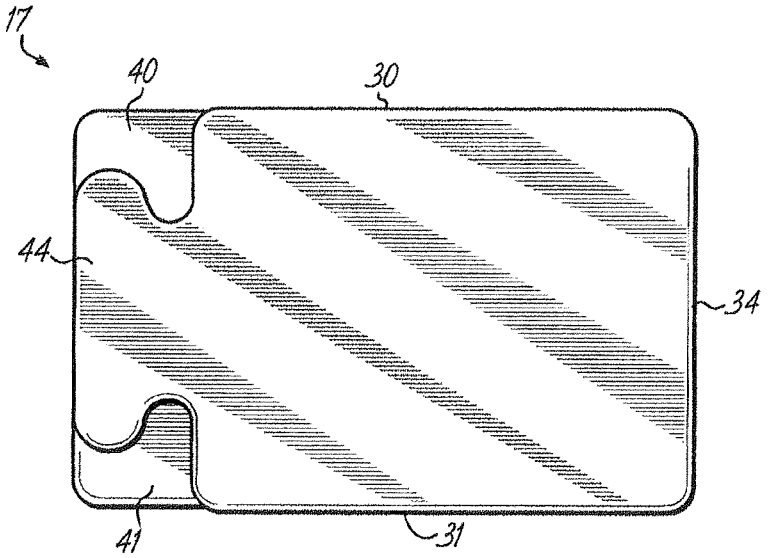
FIG. 7 is a bottom view of the invention of FIGS. 1 and 2.
Figure 8:
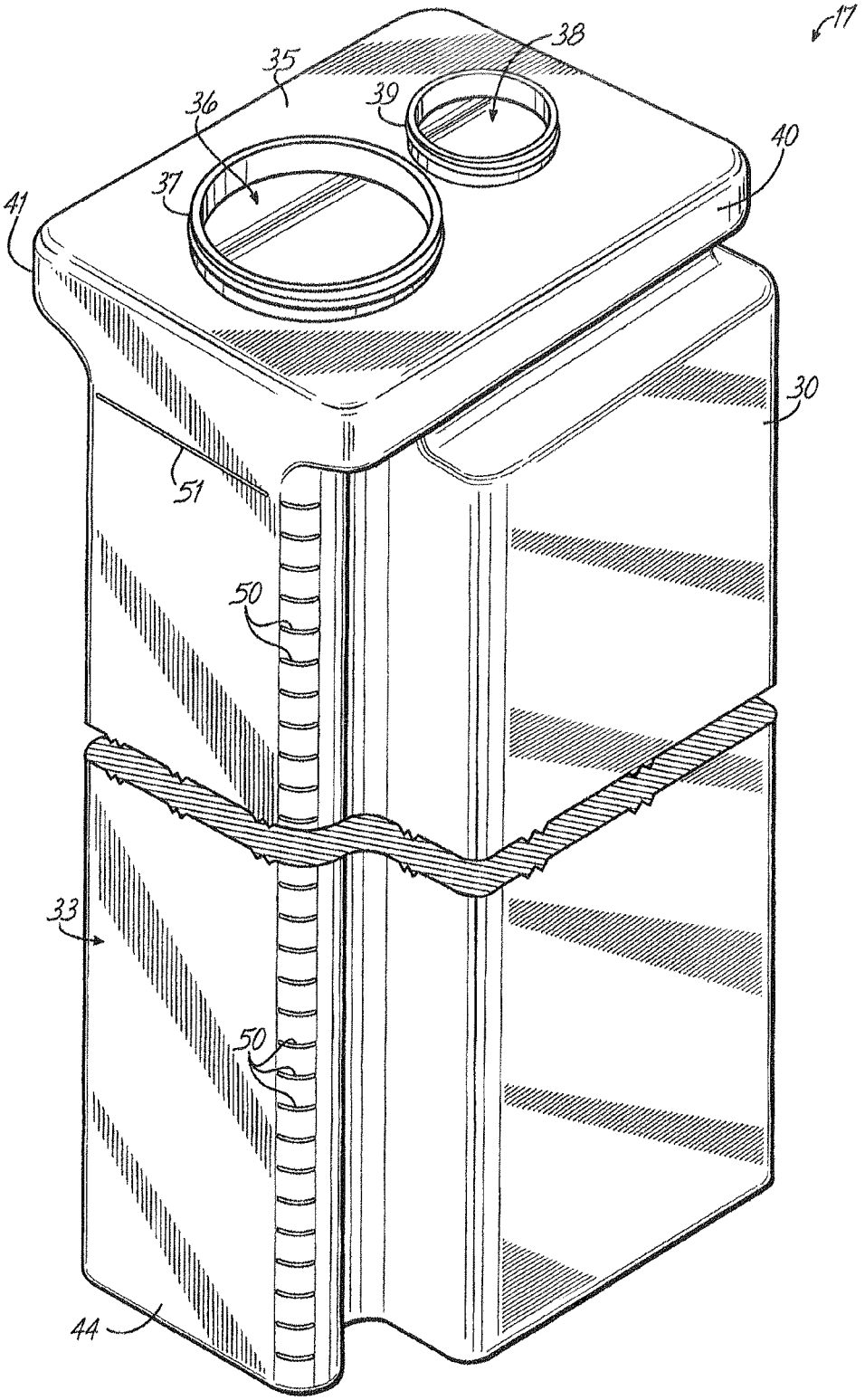
FIG. 8 is a perspective view of the reservoir of the invention and showing the fill marks and lines features added thereto as illustrated.

The top and bottom plan views of the illustrated invention of FIG. 8 are identical to FIGS. 6 and 7 and are not repeated for that reason.

Figure 9:
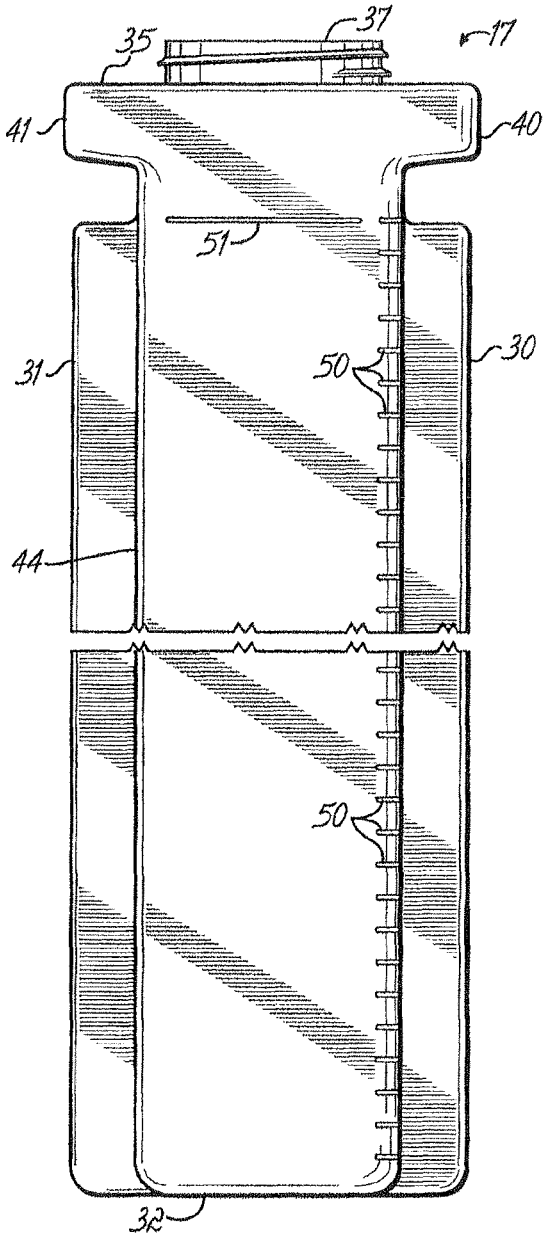
FIG. 9 is a front elevational view of the invention of FIG. 8.
Figure 10:
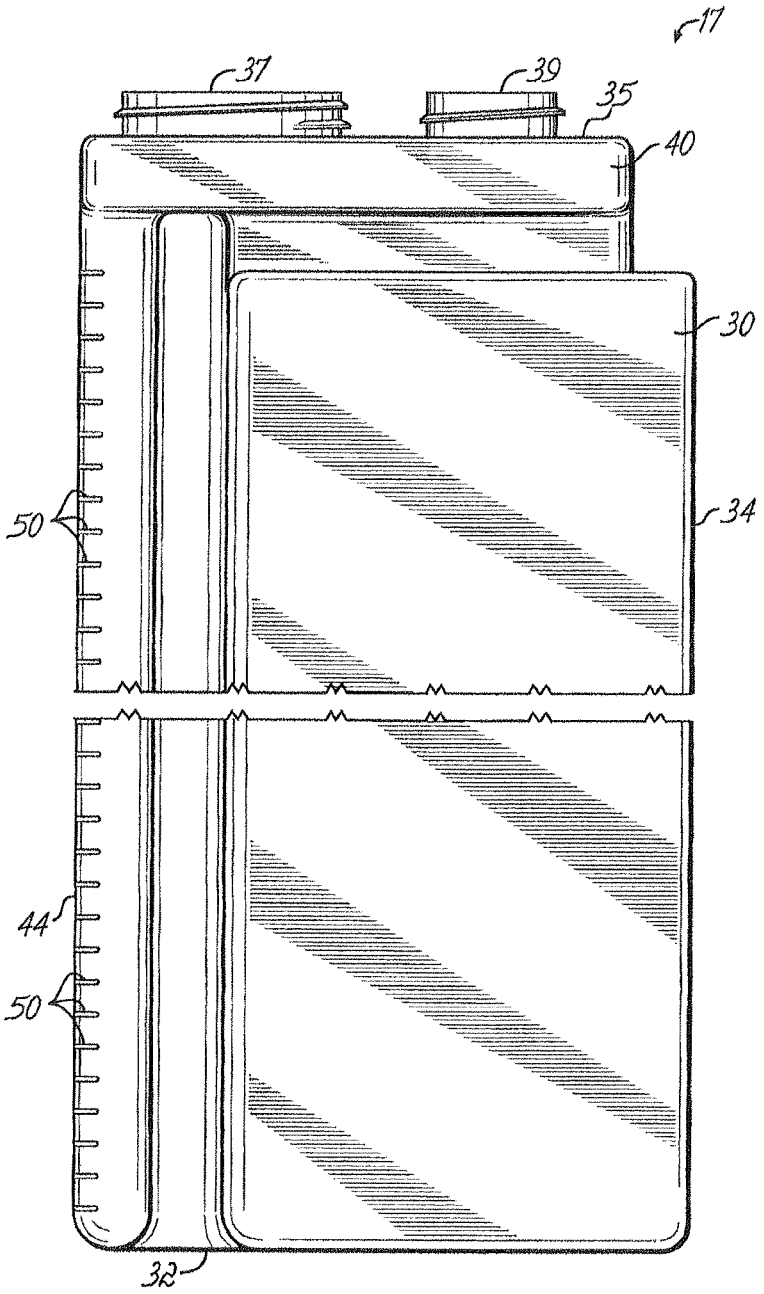
FIG. 10 is a side elevational view of the invention of FIG. 8.

The broken lines in FIGS. 8-10 are for the same purpose as those in FIGS. 2-5.

Figure 1:
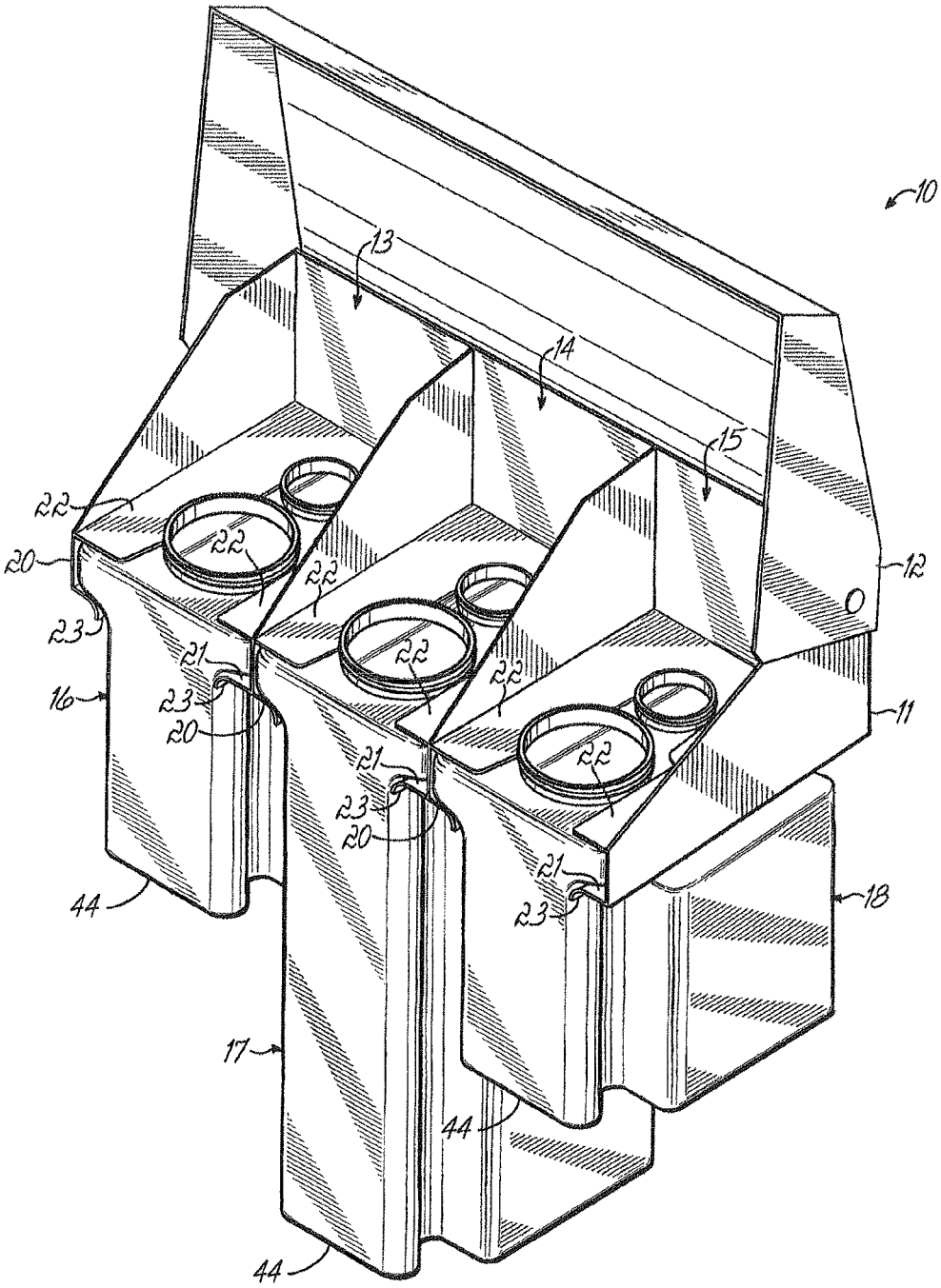
FIG. 1 is a perspective view of one embodiment of a dispenser according to the invention.
Figure 2:
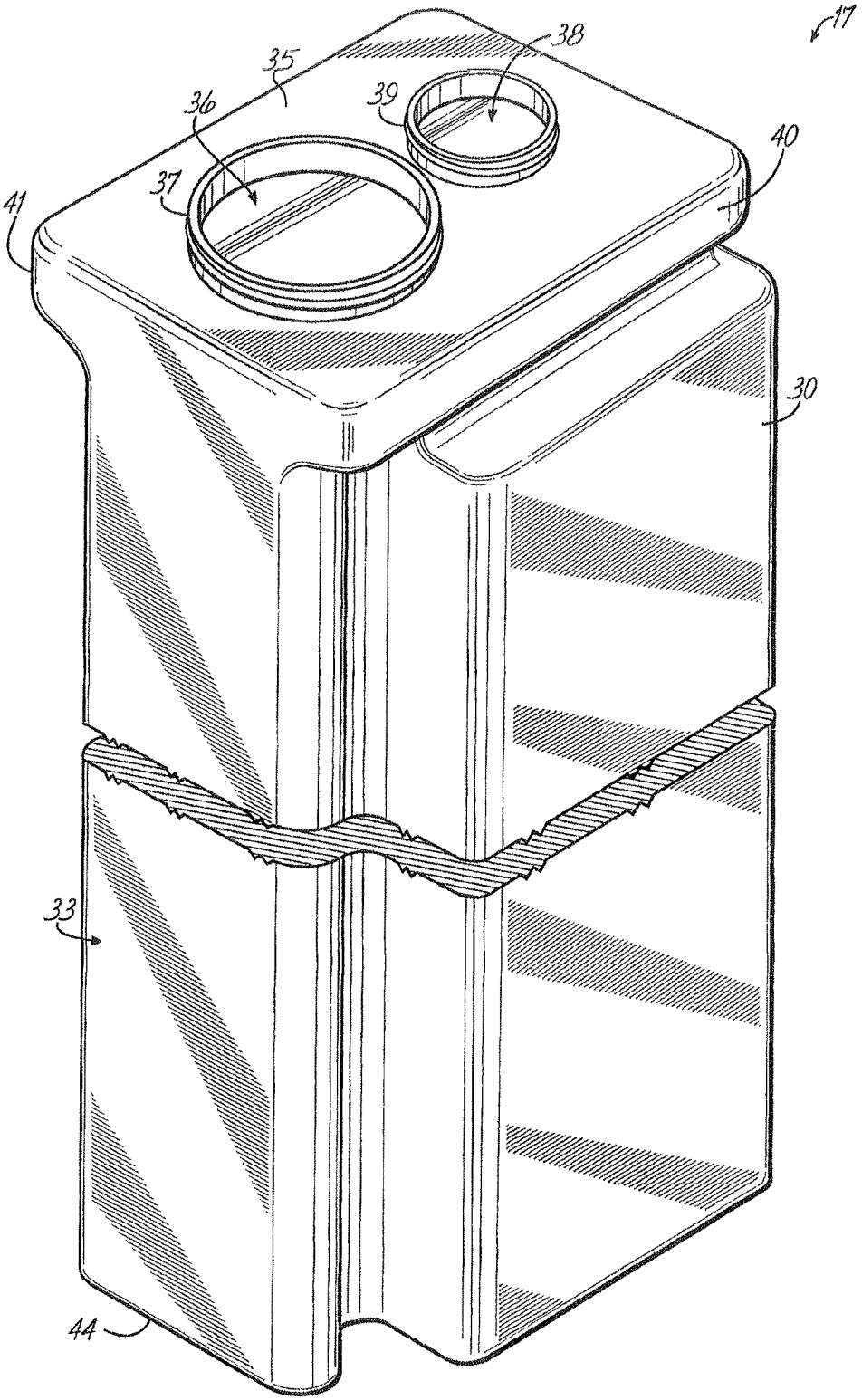
FIG. 2 is a perspective view of one embodiment of a concentrated chemical reservoir according to the invention.
Figure 3:
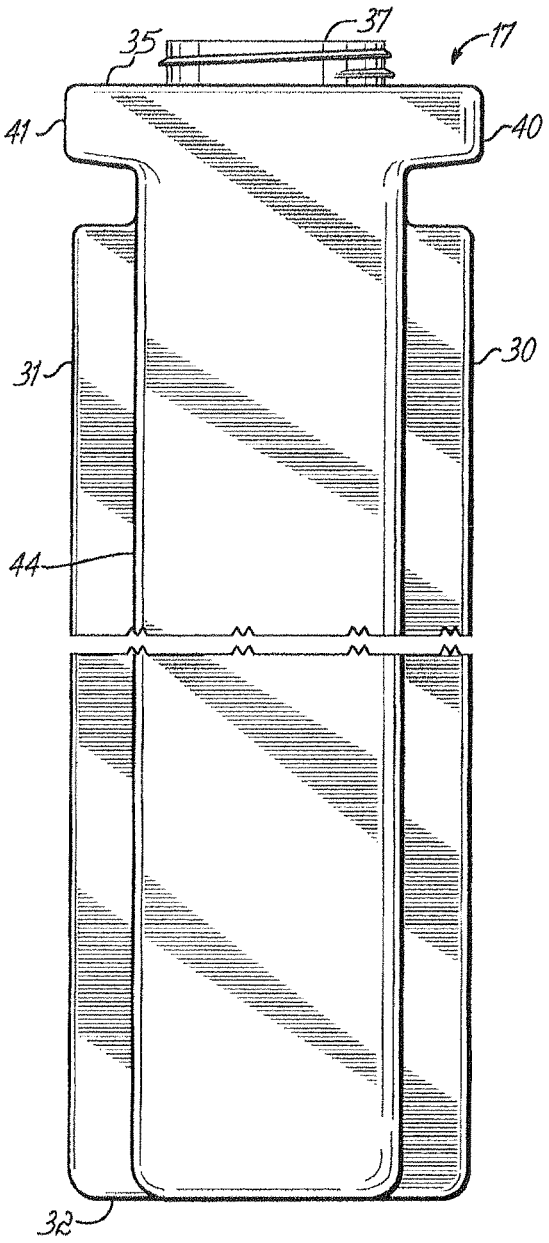
FIG. 3 is a front elevational view of the invention of FIGS. 1 and 2.
Figure 4:
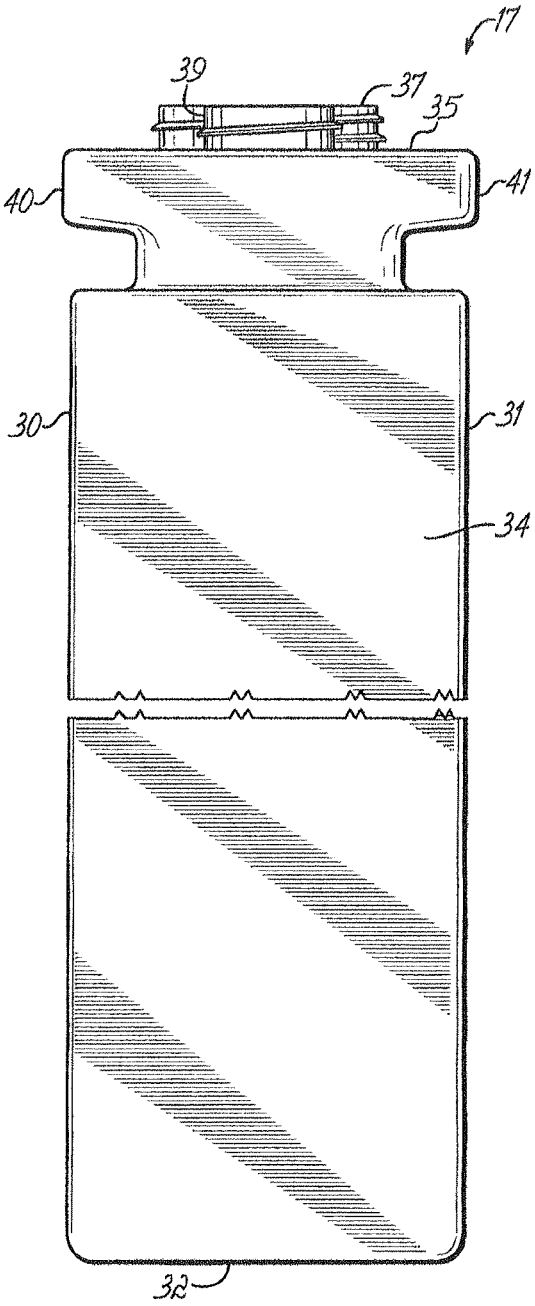
FIG. 4 is a rear elevational view of the invention of FIGS. 1 and 2.
Figure 5:
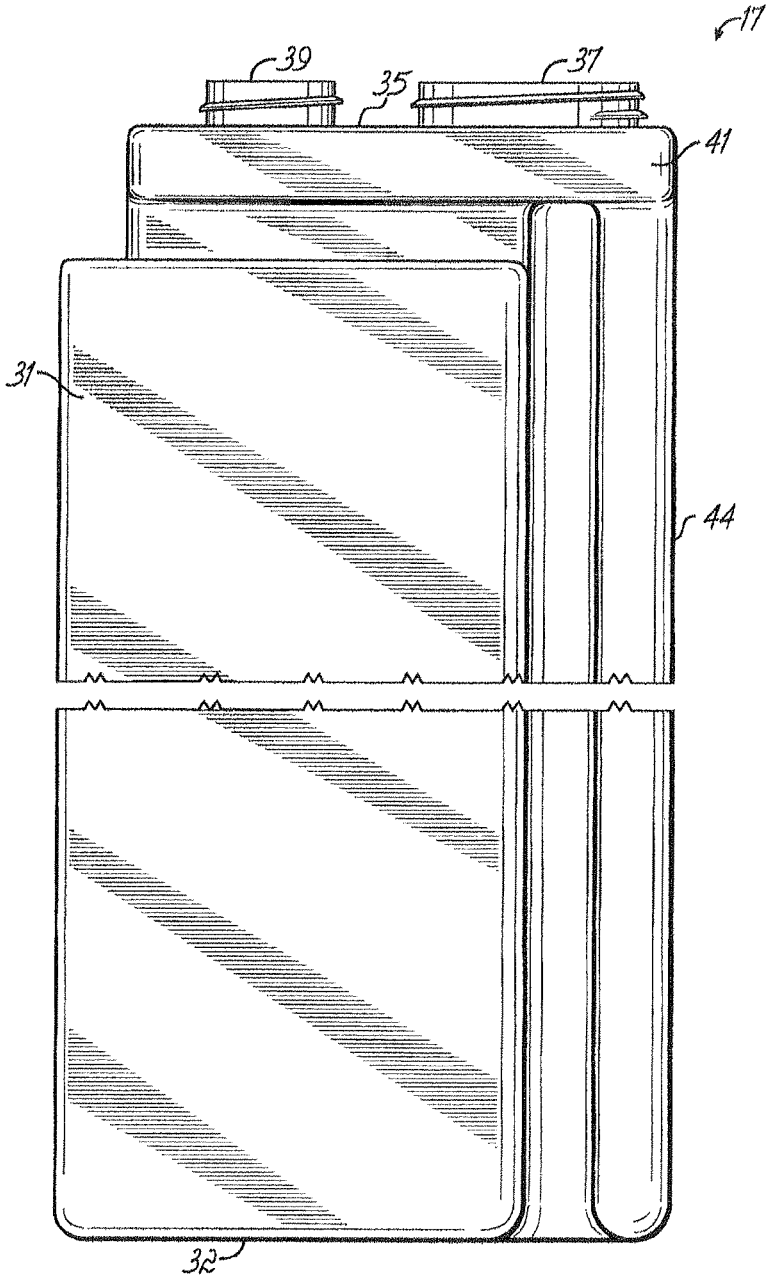
FIG. 5 is a side elevational view of the invention of FIGS. 1 and 2.

FIG. 1 illustrates a dispenser apparatus 10, according to the invention, with various components not part of the invention, removed for clarity. Dispenser apparatus 10 includes a cabinet 11 having a pivoted top 12. Cabinet 11 defines three bays 13, 14, 15, each for receiving a respective concentrated chemical reservoir 16, 17, 18. Reservoir 17 is relatively taller and of greater volume than that of reservoir 16 which is taller and of greater volume than reservoir 18.

The reservoirs 16, 17, 18 can be of any suitable length, but their top structures are preferably identical. Reference is made to U.S. Design patent application Ser. No. 291284,374, filed Sep. 6, 2007 by the same inventors and incorporated herein by reference, such application showing various design features of such reservoirs.

Each bay 13-15 of dispenser 10 has an elongated c-shaped track 20, 21 on each side of the bay. The tracks of the respective bays are preferably identical. Each track has an elongated top 22 and an elongated bottom 23 of preferably curved cross-section, these slidably receiving flanges of respective containers 16-18 in the respective bays. These tracks and their respective bays are preferably of equal length.

Further, the dispenser 10 can be provided with chemical pick-ups and eductors (not shown) for each reservoir, together with water inlets, hoses and connectors (not shown) for selecting and using chemicals for dispensing through appropriate conduits, hoses and the like as are well known. Preferably, dispenser 10 is wall, cart or rack mounted as desired.

Turning to FIGS. 2-10, these illustrate features of the reservoirs 16-18, only one of which will be described as all are preferably identical excepting their height.

Reservoir 17 includes two sides 30, 31, bottom 32, front 33, rear 34 and top 35. Top 35 includes a refillable port 36 defined by threaded boss 37. Top 35 includes a chemical pick-up port 38 defined by threaded boss 39 for connection to a chemical pick-up eductor system (not shown).

Each side member includes a respective upper flange 40, 41 configured for sliding receipt in respective tracks 20, 21. This construction enables the reservoirs to be manually slid into and out of any of the bays, respectively.

The front 33 of each reservoir defines in part an elongated projection or handle 44 narrower from side-to-side than the dimension between sides 30, 31. The projection 44 in cross-section is T-shaped, thus constituting a handle to facilitate grasping for sliding the reservoir partially out of the bay for period filling, or for removing the reservoir for cleaning.

Port 36 is relatively wide to facilitate filling with chemical concentrate while port 38 is narrower where a chemical pick-up is attached for drawing chemical out of the reservoir into a diluent for mix dispensing.

Reservoir 17 is preferably provided with a plurality of fill marks 50 and a full fill line 51, all as illustrated in FIGS. 8-10, such marks being left off FIGS. 1-7 for clarity.

In use, a vendor or chemical supplier, on a regular visit to the end user, inspects the reservoirs 16-18 of the dispenser 10. When the contents of a reservoir is depleted to the extent the remainder of concentrate is insufficient to supply the need until the next scheduled "refill" visit (noting the level as seen through the reservoir wall at handle 44), the vendor or supplier slides the selected reservoir forward, unfastens any cap over port 36 and adds chemical to the reservoir to any selected volume up to the "full" line 51 (FIGS. 8 and 9). The vendor calculates the chemical added by reference to the chemical level in the partially depleted reservoir and to the new, filled chemical level and notes the actual chemical volume added, which can then be billed to the customer, who only pays once for the chemical concentrate received and no matter how much residual chemical remained prior to filling. When larger amounts of concentrate are anticipated to be required before the next scheduled replenishment, larger reservoirs are used.

The cap over port 36 is replaced, the reservoir slid back into its bay, the top 12 closed, and dispensing normally proceeds thereafter, with chemical picked up through port 38 by any suitable pickup and eductor means.

When desired to clean the reservoir, attachments to bosses 37,39 are removed and the reservoir slid out for rinsing and cleaning.

These and other objectives and modifications will become readily apparent to those of ordinary skill in the art and applicant intends to be bound only by the claims appended hereto.

What is claimed is:

1. A method of refilling a chemical reservoir for use in a chemical dispenser including the steps of:

suspending said reservoir on a support structure of said chemical dispenser by a flange of the reservoir;

determining the level of chemical in said reservoir; sliding said reservoir from one position in said chemical dispenser outwardly to another position;

unfastening a closure over a fill port on a top portion of said reservoir for adding said chemical;

adding chemical to said reservoir;

calculating the amount of chemical added to said reservoir after the adding chemical to said reservoir step; and closing said fill port and sliding said reservoir back to said one position.

2. A method as in claim 1 including the further step of sliding said reservoir out of said dispenser for cleaning.

3. A method as in claim 1 including the step of selecting a reservoir size from a plurality of reservoirs of different sizes, as a function of frequency of refill visit schedules and volume of chemical required for use over a time period between refill visits.

4. The method of claim 3, wherein the plurality of sizes has a common shape at at least said top portion thereof such that each size of said reservoir can be interchangeably placed in the dispenser.

5. The method of claim 3, further comprising suspending at least another reservoir on said support structure, said at least another reservoir having a top portion, wherein said top portions are situated in the same plane when suspended on the dispenser.

6. The method as in claim 1, wherein:

the determining step further includes determining a first level of chemical in said reservoir before refilling by visually referencing to a plurality of fill lines on said reservoir;

the method further includes determining a second level of chemical in said reservoir after refilling by visually referencing to said plurality of fill lines in said reservoir; and the calculating step further includes calculating the amount of chemical added to said reservoir by comparing said first and second levels.

7. The method as in claim 1, further including:

billing the customer based on the amount of chemical added to said reservoir.

8. The method as in claim 1, wherein said reservoir further includes a chemical pickup port adjacent said fill port and the method further comprises drawing chemical from said pickup port.

9. The method of claim 1, further including the step of selecting a reservoir size from a plurality of reservoirs of different sizes, as a function of frequency of refill visit schedules and volume of chemical required for use over a time period between refill visits;

wherein the plurality of reservoirs has a common shape at at least said top portion thereof such that each size of said reservoir can be interchangeably placed in the dispenser.

10. The method of claim 1, further comprising:

grasping and manipulating a handle of said reservoir, said handle being integral with said reservoir.

11. The method of claim 1, wherein said flange is integral with said reservoir.

12. A method of refilling a chemical reservoir for use in a chemical dispenser including the steps of:

selecting a reservoir size from a plurality of reservoirs of different sizes, as a function of frequency of refill visit schedules and volume of chemical required for use over a time period between refill visits;

suspending said reservoir on the dispenser;

grasping and manipulating a handle of said reservoir, said handle being integral with said reservoir;

sliding said reservoir from one position in said dispenser outwardly to another position;

unfastening a closure over a fill port in said reservoir for adding chemical;

determining a first level of chemical in said reservoir;

adding chemical to said reservoir such that a portion of the volume of chemical occupies a space in said reservoir defining at least part of said handle;

closing said fill port and sliding said reservoir back to said one position; and calculating the amount of chemical added to said reservoir.

13. The method of claim 12, wherein:

the determining step further includes determining a first level of chemical in said reservoir before refilling by visually referencing to a plurality of fill lines on said reservoir;

the method further includes determining a second level of chemical in said reservoir after refilling by visually referencing to said plurality of fill lines in said reservoir; and the calculating step further includes calculating the amount of chemical added to said reservoir by comparing said first and second levels.

14. The method of claim 12, wherein the plurality of sizes has a common shape at at least a top portion thereof such that each size of said reservoir can be interchangeably suspended in the dispenser.

15. A method of refilling a chemical reservoir for use in a chemical dispenser including the steps of:

selecting a reservoir size from a plurality of reservoirs of different sizes, as a function of frequency of refill visit schedules and volume of chemical required for use over a time period between refill visits;

suspending said reservoir on a support structure of said dispenser, wherein:

said reservoir comprises a top portion, said top portion including a fill port and being situated in a first plane in a first position;

grasping and manipulating a handle of said reservoir;

sliding said reservoir from said first position outwardly to a second position along said support structure, wherein said top portion remains situated in said first plane regardless of its relative position along said support structure;

determining a first level of chemical in said reservoir before refilling;

unfastening a closure over a fill port in said reservoir for adding said chemical;

adding chemical to said reservoir;

closing said fill port and sliding said reservoir back to said first position;

determining a second level of chemical in said reservoir after refilling; and calculating the amount of chemical added to said reservoir by comparing said first and second levels.

16. The method of claim 15, wherein the suspending step further includes interchangeably suspending different sizes of said reservoir such that a top portion of each reservoir is situated in the same plane.

17. The method of claim 15, further comprising adding chemical to said reservoir such that a portion of the volume of chemical occupies a space in the reservoir defining at least part of said flange.

* * * * *